US007246405B2

(12) United States Patent
Yan

(10) Patent No.: US 7,246,405 B2
(45) Date of Patent: Jul. 24, 2007

(54) SELF-MOVING VACUUM CLEANER WITH MOVEABLE INTAKE NOZZLE

(76) Inventor: Jason Yan, No. 8, Lane 108, Ya-Chou Rd., Tu-Cheng City, Taipei Hsien (TW)

( * ) Notice: Subject to any disclaimer, the term of this patent is extended or adjusted under 35 U.S.C. 154(b) by 582 days.

(21) Appl. No.: 10/748,810

(22) Filed: Dec. 30, 2003

(65) Prior Publication Data

US 2005/0076466 A1 Apr. 14, 2005

(30) Foreign Application Priority Data

Oct. 9, 2003 (TW) ..... 92218151 U

(51) Int. Cl.
*A47L 9/02* (2006.01)

(52) U.S. Cl. ..... 15/340.1; 359/403

(58) Field of Classification Search ..... 15/340.1, 15/393, 403, 354, 359
See application file for complete search history.

(56) References Cited

U.S. PATENT DOCUMENTS 5,781,960 A * 7/1998 Kilstrom et al. ..... 15/319
6,481,515 B1 * 11/2002 Kirkpatrick et al. ..... 15/319
6,581,239 B1 * 6/2003 Dyson et al. ..... 15/340.3
6,591,447 B2 * 7/2003 Wegelin et al. ..... 15/359
6,601,265 B1 * 8/2003 Burlington ..... 15/340.1
6,938,298 B2 * 9/2005 Aasen ..... 15/319
2004/0031113 A1 * 2/2004 Wosewick et al. ..... 15/340.1
2004/0031121 A1 * 2/2004 Martin et al. ..... 15/403

* cited by examiner

*Primary Examiner*—Theresa T. Snider
(74) *Attorney, Agent, or Firm*—Bacon & Thomas, PLLC

(57) ABSTRACT

A self-moving vacuum cleaner includes a duct disposed in a casing and having a vacuum inlet which extends downwardly of a bottom wall of the casing, and an impeller disposed to draw dust from the floor surface through the vacuum inlet into the duct. An intake nozzle includes a tubular nozzle body which has an upper end communicated with and retainingly slidable relative to the vacuum inlet so as to enable a lower end of the nozzle body to be movable between upper and lower positions, and an anchoring member which is hinged to the bottom wall such that the nozzle body is swingable between the upper and lower positions in response to unevenness of the floor surface, thereby enabling the lower end to keep trailing on the floor surface when the casing moves.

2 Claims, 5 Drawing Sheets

SELF-MOVING VACUUM CLEANER WITH MOVEABLE INTAKE NOZZLE

CROSS-REFERENCE TO RELATED APPLICATION

This application claims priority of Taiwanese Application No. 092218151, filed on Oct. 9, 2003.

BACKGROUND OF THE INVENTION

1. Field of the Invention

This invention relates to a self-moving vacuum cleaner, more particularly to a self-moving vacuum cleaner with an intake nozzle which is movable in response to an unevenness of the floor surface.

2. Description of the Related Art

Referring to FIG. 1, a conventional robotic vacuum cleaner is shown to include a casing 91 which has an impeller 911 and a duct 912 mounted therein. The duct 912 has a vacuum inlet 913 which extends downwardly of a bottom wall of the casing 91 for drawing dust from the floor surface 92 through the vacuum inlet 913 into the duct 912. The dust passes through a filter (not shown) and is collected in a collection bag or bin (not shown). Since the distance between the vacuum inlet 913 and the floor surface 92 is fixed, a relatively large distance may result in deterioration of the cleaning performance of the cleaner, while a relatively small distance may result in blocking of the vacuum inlet 913 by a bump 921 on the floor surface 92 such that the cleaner may become stuck during the cleaning operation.

SUMMARY OF THE INVENTION

The object of the present invention is to provide a self-moving vacuum cleaner which can suit a variety of the floor surfaces and which has a movable intake nozzle that can ensure the cleaning performance of the vacuum cleaner on an uneven floor surface.

According to this invention, the self-moving vacuum cleaner includes a casing having a bottom wall which has leading and trailing ends opposite to each other in a longitudinal direction, a duct disposed in the casing and having a vacuum inlet which extends downwardly of the bottom wall, and an impeller disposed in the casing and downstream of the vacuum inlet so as to draw dust from the floor surface through the vacuum inlet into the duct. An intake nozzle includes a tubular nozzle body and an anchoring member. The tubular nozzle body is disposed upstream of the vacuum inlet, and has a lower end adapted to trail on the floor surface, and an upper end extending upwardly from the lower end. The upper end is communicated with and is retainingly slidable relative to the vacuum inlet, and is configured such that the lower end is movable relative to the vacuum inlet between upper and lower positions so as to be close to and away from the vacuum inlet, respectively. The anchoring member is disposed opposite to the tubular nozzle body in the longitudinal direction and proximate to the leading end, and is hinged to the bottom wall about a hinge axis transverse to the longitudinal direction. As such, the tubular nozzle body is swingable about the hinge axis between the upper and lower positions in response to unevenness of the floor surface, thereby enabling the lower end to keep trailing on the floor surface when the casing advances with the leading end.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
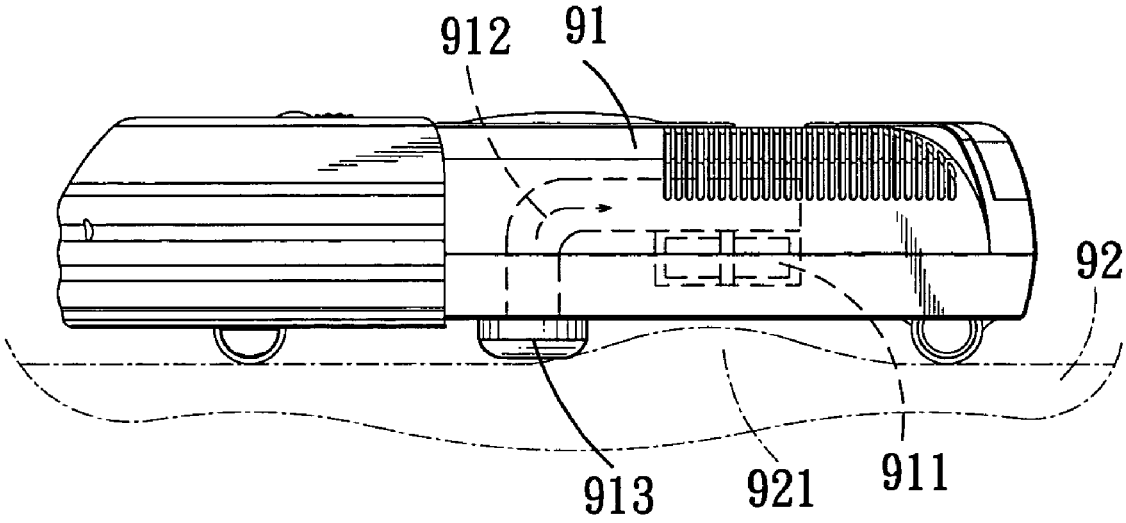
FIG. 1 PRIOR ART
FIG. 1 is a schematic side view of a conventional robotic vacuum cleaner.
Figure 2:
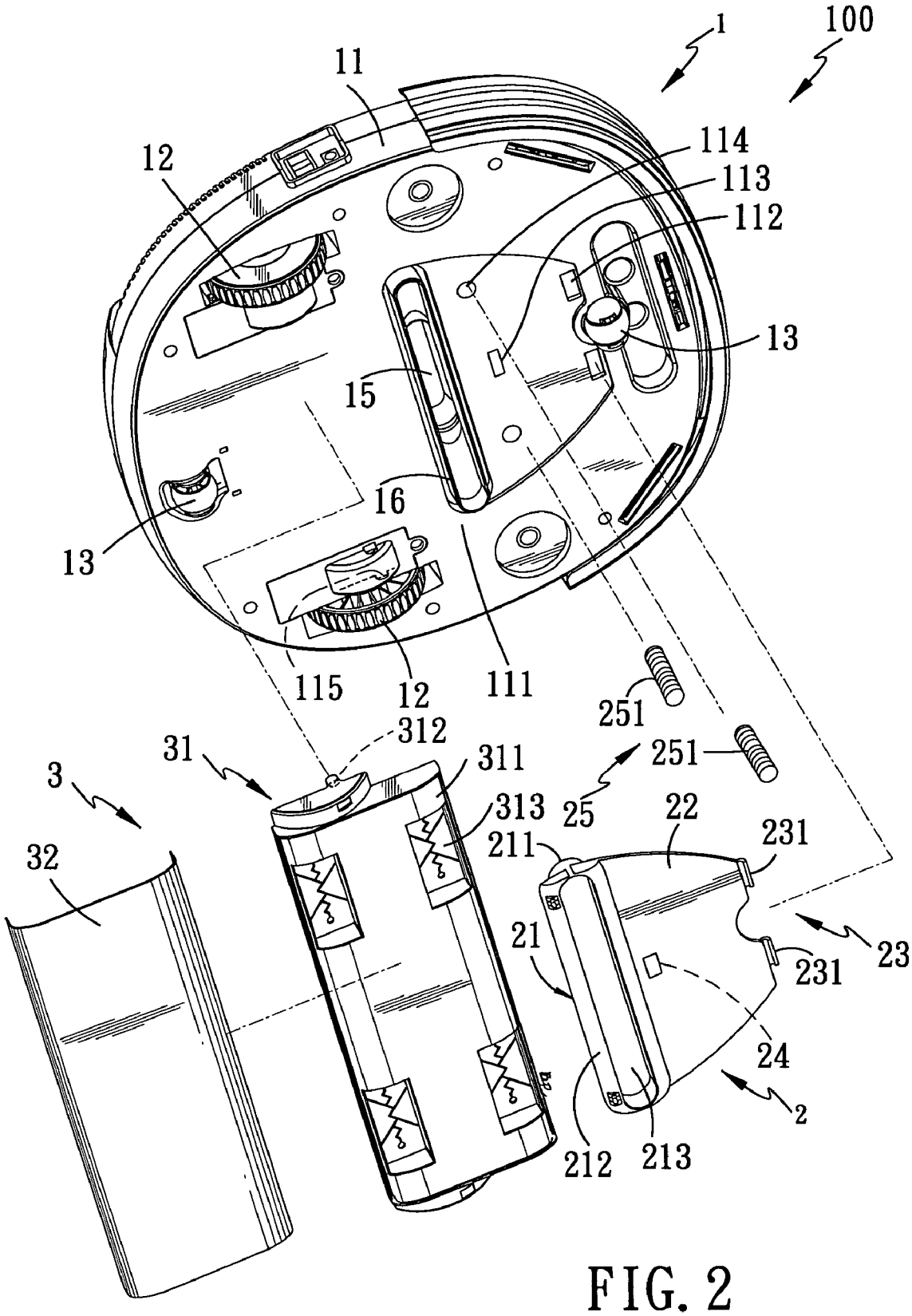
FIG. 2 is an exploded perspective view of the preferred embodiment of a self-moving vacuum cleaner according to this invention when viewed from a bottom side thereof.
Figure 3:
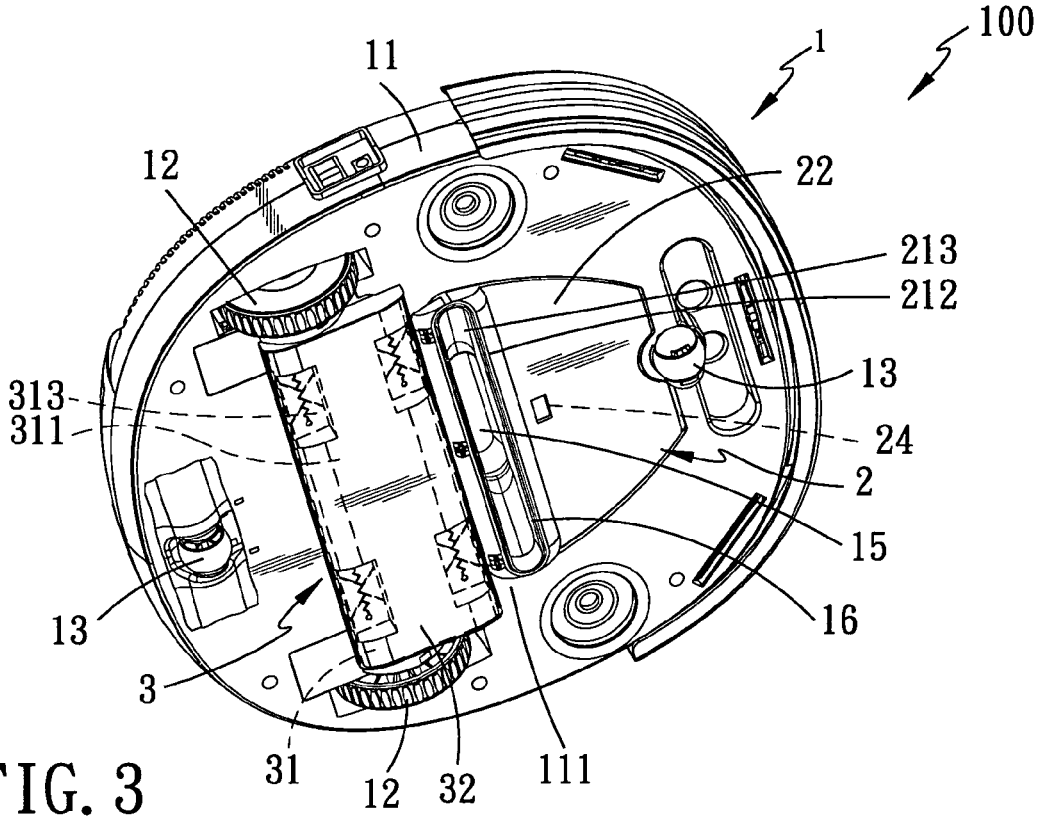
FIG. 3 is a bottom perspective view of the preferred embodiment.
Figure 4:
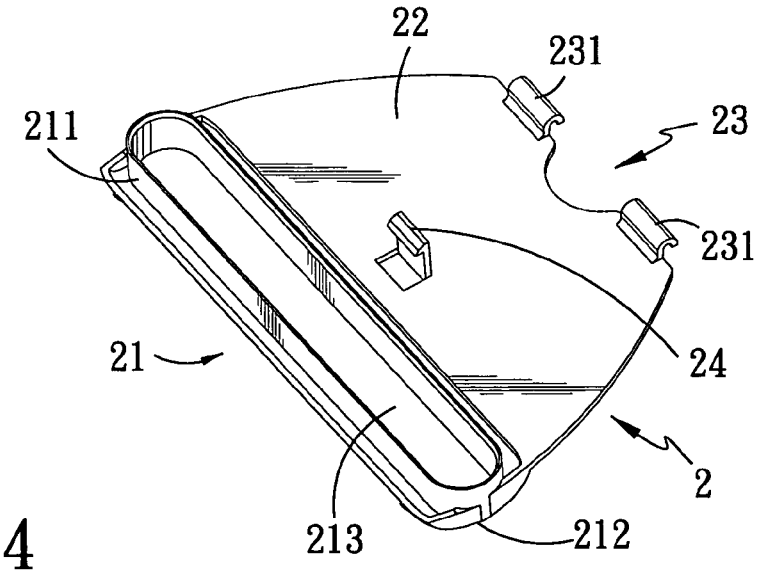
FIG. 4 is a perspective view of an intake nozzle of the preferred embodiment.
Figure 5:
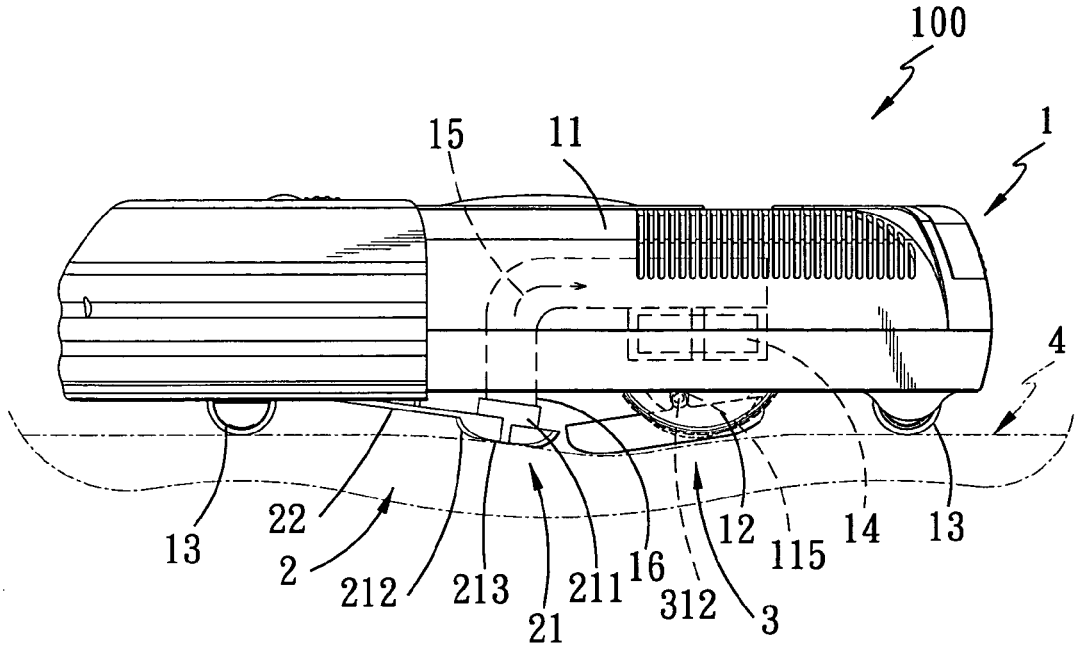
FIGS. 5 and 6 are a schematic side view and a partly sectional view of the preferred embodiment showing the intake nozzle in a lower position, respectively.

Referring to FIGS. 2 and 3, the preferred embodiment of a self-moving vacuum cleaner 100 according to the present invention is shown to comprise a cleaner body 1, an intake nozzle 2, and a wiping device 3 for cleaning a floor surface 4 (see FIG. 5).

The cleaner body 1 includes a casing 11, a pair of driving wheels 12 rotatably mounted on a bottom wall 111 of the casing 11, and two rollers 13 rotatably mounted on leading and trailing ends of the bottom wall 111, which are opposite to each other in a longitudinal direction. Control circuits and elements (not shown) are provided in the casing 11 to control a pair of motors (not shown) to actuate rotation of the driving wheels 12, respectively, thereby driving the cleaner body 1 to self-move on the floor surface 4 in a predetermined mode. Since the construction of the control circuits and elements is hitherto known, a description thereof is dispensed with herein for the sake of brevity.

Figure 6:
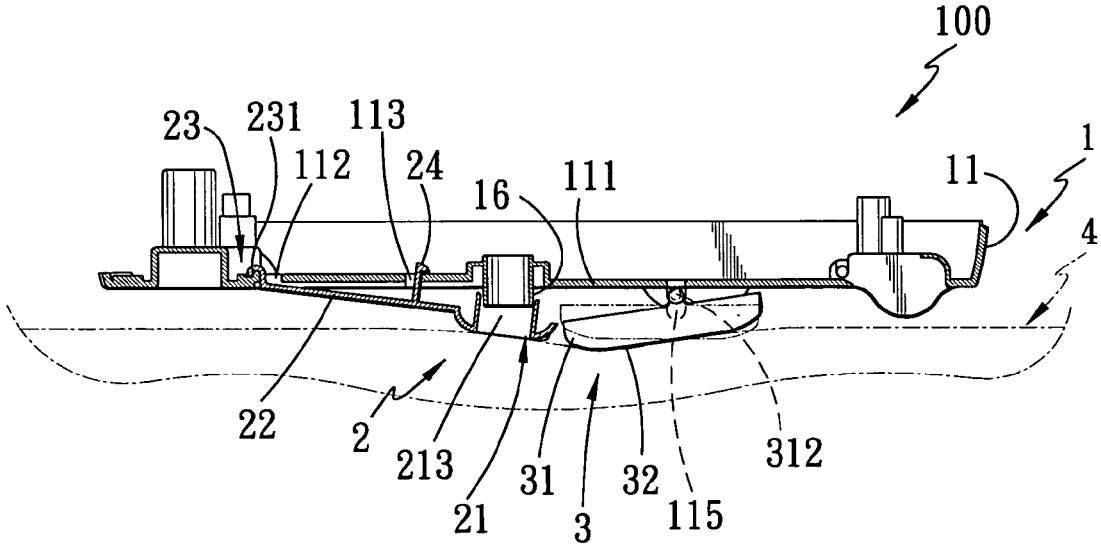
Figure 7:
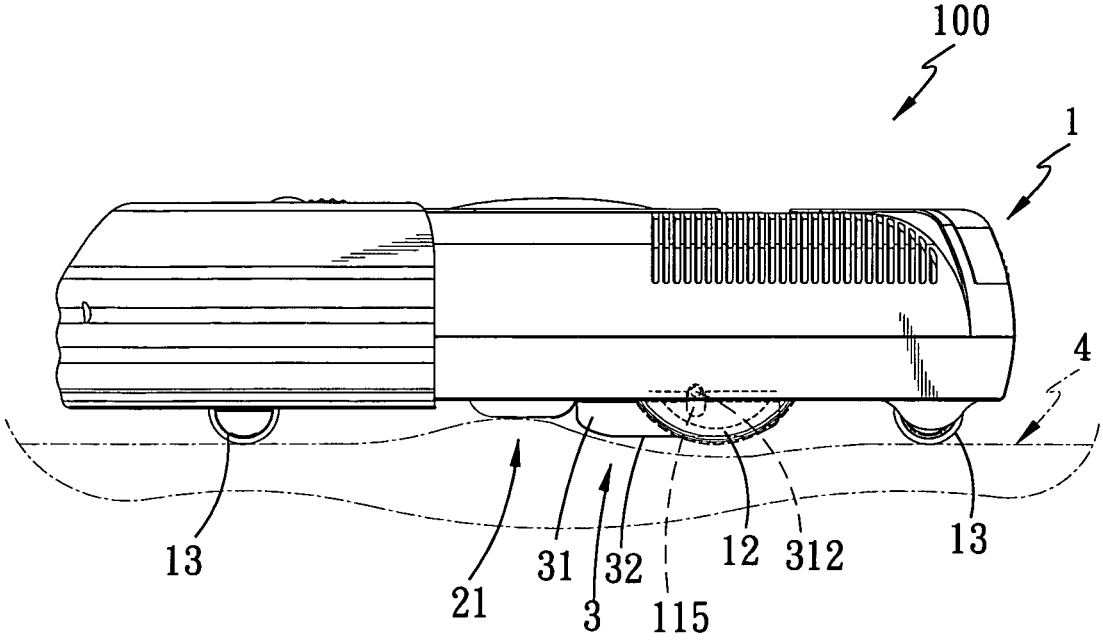
FIGS. 7 and 8 are a schematic side view and a partly sectional view of the preferred embodiment showing the intake nozzle in an upper position, respectively.
Figure 8:
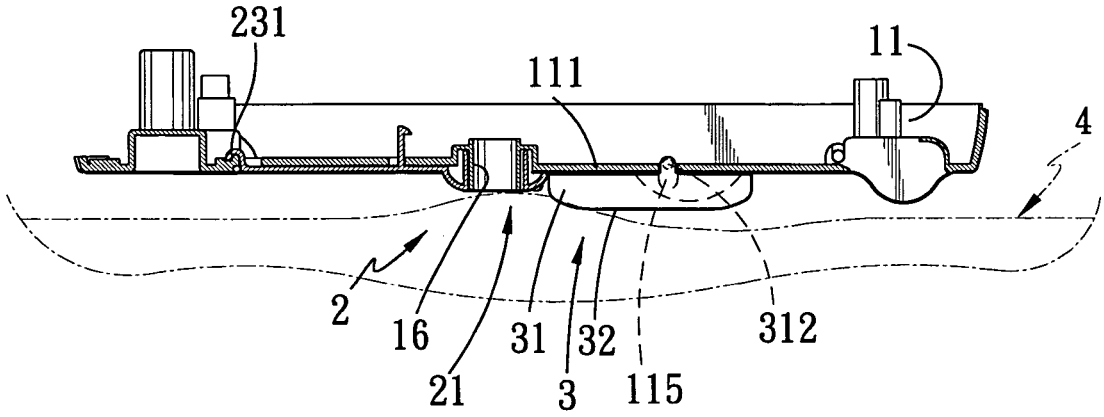

With reference to FIGS. 2, 5 and 6, the cleaner body 1 further includes a duct 15 which is disposed in the casing 11 and which has a vacuum inlet 16 extending downwardly of the bottom wall 111, an impeller 14 which is disposed in the casing 11 and downstream of the vacuum inlet 16 so as to draw dust from the floor surface 4 through the vacuum inlet 16 into the duct 15, and a filter (not shown) which is disposed in the casing 11 to filter the dust in the duct 15. The vacuum inlet 16 is in form of an elongated tube extending in a transverse direction relative to the longitudinal direction.

As shown in FIGS. 2, 4, 5 and 6, the intake nozzle 2 includes a tubular nozzle body 21, an anchoring member 23, and a plate-shaped intermediate member 22 which is interposed between and which interconnects the tubular nozzle body 21 and the anchoring member 23. The tubular nozzle body 21 is disposed upstream of the vacuum inlet 16. In particular, the tubular nozzle body 21 includes an upper end 211 which is in form of an elongated tube and which is slidably sleeved on and which is communicated with the vacuum inlet 16, and an arcuate lower end 212 which extends downwardly from the upper end 211 so as to form an inlet port 213 and which is adapted to trail on the floor surface 4. Thus, the lower end 212 is movable relative to the vacuum inlet 16 between upper and lower positions so as to be close to and away from the vacuum inlet 16, respectively.

The anchoring member 23 is disposed opposite to the tubular nozzle body 21 in the longitudinal direction and proximate to the leading end of the bottom wall 111, and includes two arcuate anchoring portions 231 which are disposed opposite to each other in the transverse direction and which are hinged to two holes 112 formed in the bottom wall 111 such that the tubular nozzle body 21 is swingable about a hinge axis in the transverse direction between the upper and lower positions in response to unevenness of the floor surface 4, thereby enabling the lower end 212 to keep trailing on the floor surface 4 when the casing 11 advances ahead with the leading end. Moreover, an upright hook portion 24 is disposed to extend towards and is slidably inserted into a through hole 113 formed through the bottom wall 111 between the leading and trailing ends. Thus, in the lower position, as shown in FIG. 6, the upright hook portion 24 is retained in the through hole 113 so as to prevent the tubular nozzle body 21 from further downward movement. A biasing member 25 includes a pair of compression springs 251 which are mounted in two engaging holes 114 formed in the bottom wall 111 and which abut against the intermediate member 22 so as to bias the tubular nozzle body 21 towards the floor surface 4.

Referring to FIGS. 5 to 8, when the tubular nozzle body 21 is sleeved on the vacuum inlet 16, and the anchoring portions 231 of the anchoring member 23 are respectively hinged to the holes 112 in the bottom wall 111, the lower end 212 can be moved between the upper and lower positions in response to the unevenness of the floor surface 4 so as to keep trailing on the floor surface 4, thereby ensuring the vacuum cleaning effect of the cleaner 100. Moreover, by virtue of the intermediate member 22, when the cleaner body 1 encounters a bump (not shown) on the floor surface 4, the casing 11 advances with the intermediate member 22 so as to move the tubular nozzle body 21 to the upper position so that the tubular nozzle body 21 can move over the bump while trailing on the floor surface 4, thereby preventing blocking of the cleaner body 1.

Referring again to FIGS. 2 and 3, the wiping device 3 includes a wiping body 31 and a dusting fabric 32. The wiping body 31 has a rectangular body portion 311 and two ball joints 312 which are disposed on two sides of the body portion 311 opposite to each other in the transverse direction and which are loosely connected to two top-open slots 115 formed in the bottom wall 111 of the casing 11 so as to enable the wiping body 31 to be movable towards the bottom wall 111. The body portion 311 has a lower wall surface which is adapted to trail on the floor surface 4 and which has four resiliently retaining slits 313 at four corners thereof. Thus, the lower wall surface of the body portion 311 is movable upwardly and downwardly, and is swingable about a joint axis along the ball joints 312 so as to keep trailing on the floor surface 4. The dusting fabric 32, such as a cloth with static electricity, is resiliently retained in the slits 313 and is removably attached to the lower wall surface of the wiping body 31 for wiping the floor surface 4 during the cleaning operation of the vacuum cleaner 100.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A self-moving vacuum cleaner comprising:

a casing having a bottom wall which has leading and trailing ends opposite to each other in a longitudinal direction;

a duct disposed in said casing and having a vacuum inlet which extends downwardly of said bottom wall;

an impeller disposed in said casing and downstream of said vacuum inlet so as to draw dust from a floor surface through said vacuum inlet into said duct;

an intake nozzle including a tubular nozzle body which is disposed upstream of said vacuum inlet, and which has a lower end that is adapted to trail on the floor surface, and an upper end that extends upwardly from said lower end, that is communicated with and that is retainingly slidable relative to said vacuum inlet, said upper end being configured such that said lower end is movable relative to said vacuum inlet between upper and lower positions so as to be close to and away from said vacuum inlet, respectively, wherein said upper end of said tubular nozzle body is sleeved slidably on said vacuum inlet so as to render said lower end movable relative thereto, and an anchoring member which is disposed opposite to said tubular nozzle body in the longitudinal direction and proximate to said leading end, and which is hinged to said bottom wall about a hinge axis transverse to the longitudinal direction such that said tubular nozzle body is swingable about the hinge axis between the upper and lower positions in response to unevenness of the floor surface, thereby enabling said lower end to keep trailing on the floor surface when said casing advances with said leading end;

wherein said bottom wall has a through hole extending therethrough and formed between said leading and trailing ends, said intake nozzle further including an intermediate member which is interposed between and which interconnects said tubular nozzle body and said anchoring member, and an upright hook portion which extends towards and which is slidably insertable into said through hole, and which is configured such that in the lower position, said upright hook portion is retained in said through hole so as to prevent said tubular nozzle body from further downward movement;

a biasing member disposed between said bottom wall and said intermediate member to bias said tubular nozzle body towards the floor surface; and a wiping device that includes a wiping body having a lower wall surface adapted to trail on the floor surface, and a ball joint jointed to said bottom wall so as to enable said lower wall surface to keep trailing on the floor surface, and a dusting fabric which is removably attached to said lower wall surface of said wiping body for wiping the floor surface;

wherein said ball joint of said wiping body is loosely connected to said bottom wall so as to enable said wiping body to be movable toward said bottom wall.

2. The self-moving vacuum cleaner of claim 1, wherein said dusting fabric is a cloth with static electricity and is resiliently retained on said wiping body.

* * * * *